US006029376A

United States Patent [19]

Cass

[11] Patent Number: 6,029,376

[45] Date of Patent: Feb. 29, 2000

[54] ARTICLE OF FOOTWEAR

[75] Inventor: William Cass, Hillsboro, Oreg.

[73] Assignee: Nike, Inc., Beaverton, Oreg.

[21] Appl. No.: 09/219,312

[22] Filed: Dec. 23, 1998

[51] Int. Cl.[7] ..... A43C 11/00

[52] U.S. Cl. ..... 36/50.1; 36/51; 36/58.5

[58] Field of Search ..... 36/50.1, 50.5, 36/51, 45, 88, 89, 9 R, 58.5

[56] References Cited

U.S. PATENT DOCUMENTS

| | | | |
|---|---|---|---|
| 177,396 | 5/1876 | Harris . | |
| D. 364,266 | 11/1995 | Orzeck . | |
| D. 390,694 | 2/1998 | Lozano . | |
| 459,616 | 9/1891 | von Rohonczy . | |
| 1,803,554 | 5/1931 | Knilans . | |
| 2,147,197 | 2/1939 | Glidden . | |
| 2,934,838 | 5/1960 | Ferreira . | |
| 3,138,880 | 6/1964 | Kunzli . | |
| 3,931,685 | 1/1976 | Laukaitis . | |
| 4,342,160 | 8/1982 | Clark . | |
| 4,447,967 | 5/1984 | Zaino . | |
| 4,616,432 | 10/1986 | Bunch et al. . | |
| 4,619,058 | 10/1986 | Gumbert . | |
| 4,665,634 | 5/1987 | Diaz . | |
| 4,736,531 | 4/1988 | Richard . | |
| 4,769,927 | 9/1988 | Liggett et al. . | |
| 4,813,158 | 3/1989 | Brown . | |
| 4,845,864 | 7/1989 | Corliss . | |
| 4,972,609 | 11/1990 | Oh et al. . | |
| 5,184,378 | 2/1993 | Batra . | |
| 5,243,772 | 9/1993 | Francis et al. | 36/45 X |
| 5,253,434 | 10/1993 | Curley, Jr. et al. . | |
| 5,319,869 | 6/1994 | McDonald et al. . | |
| 5,339,544 | 8/1994 | Caberlotto . | |
| 5,371,957 | 12/1994 | Gaudio | 36/45 X |
| 5,377,430 | 1/1995 | Hatfield et al. . | |
| 5,392,535 | 2/1995 | Van Noy et al. . | |
| 5,467,537 | 11/1995 | Aveni et al. . | |
| 5,497,564 | 3/1996 | Allen et al. . | |
| 5,555,650 | 9/1996 | Longbottom et al. . | |
| 5,647,150 | 7/1997 | Romanato et al. . | |
| 5,651,195 | 7/1997 | Clancy . | |
| 5,659,982 | 8/1997 | Muraoka et al. . | |
| 5,692,319 | 12/1997 | Parker et al. . | |
| 5,771,608 | 6/1998 | Peterson | 36/89 |
| 5,896,683 | 4/1999 | Foxen et al. | 36/89 |

OTHER PUBLICATIONS

Footwear News, The Next Step "Mesh and welding give Vans' Articulate a futuristic feel," p. 14, Sep. 7, 1998.

*Primary Examiner*—Ted Kavanaugh
*Attorney, Agent, or Firm*—Banner & Witcoff, Ltd.

[57] ABSTRACT

An article of footwear including a sole and an upper for enclosing and supporting the foot. The upper includes a tongueless outer sleeve of flexible woven elastic material, such as spandex, that allows the outer sleeve to expand and contract around a foot of a wearer. A flexible cage of support elements is permeation bonded to the inside or outside of the outer sleeve by welding to provide additional support. Tensioning elements are located at the upper ends of the support elements. A lace is routed through superimposed holes in the tensioning elements and the outer sleeve. Tightening of the lace causes the tightening of the flexible cage to further secure the article of footwear to the foot of the wearer. A breathable inner sleeve provides additional support for the foot of the wearer and protects the foot from pressure points due to the lacing under the outer sleeve. The outer sleeve protects portions of the lace that extend between the inner and outer sleeve. A counter can be used to stiffen the shoe in selected areas. A heel strap can be used with a heel counter to lock the heel of the wearer into the shoe.

35 Claims, 3 Drawing Sheets

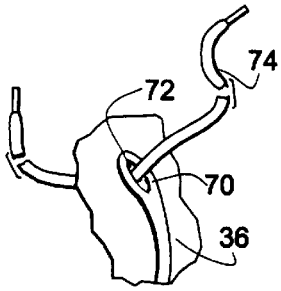
FIG. 2
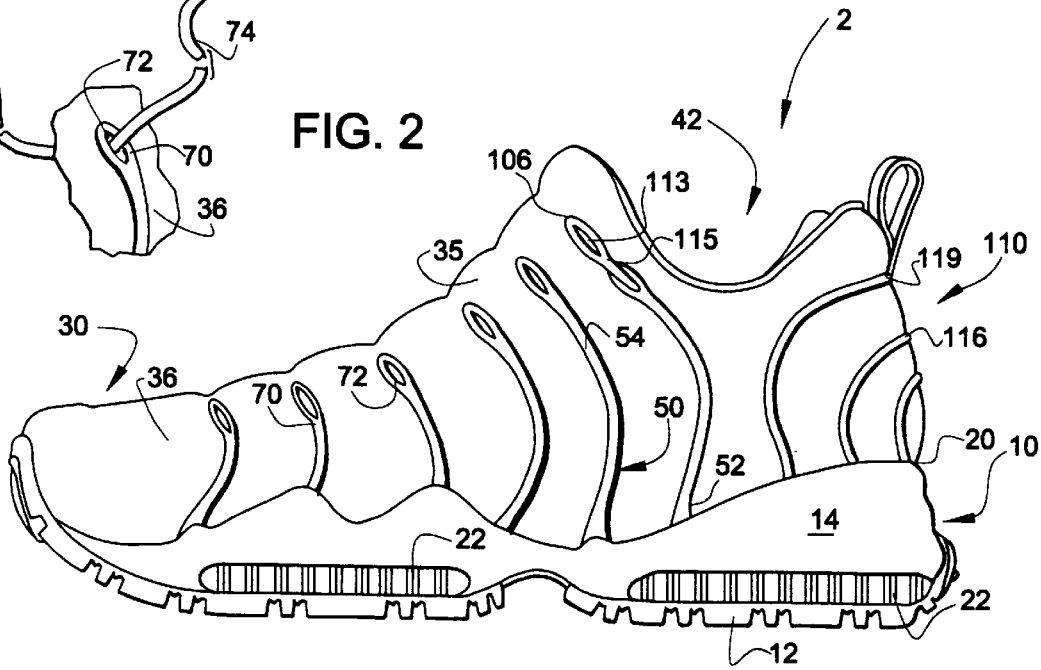
FIG. 1
FIG. 3
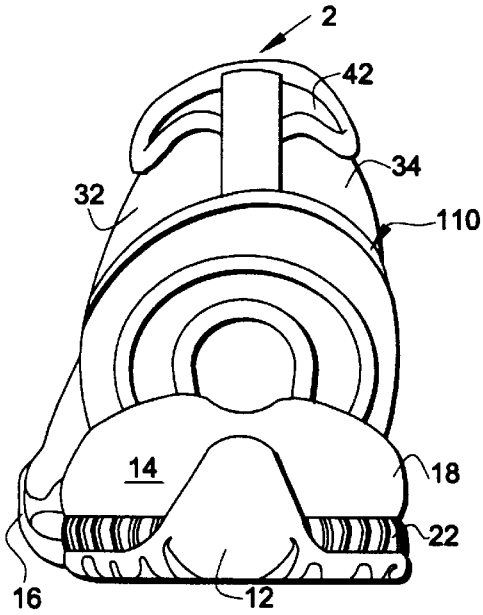
FIG. 4
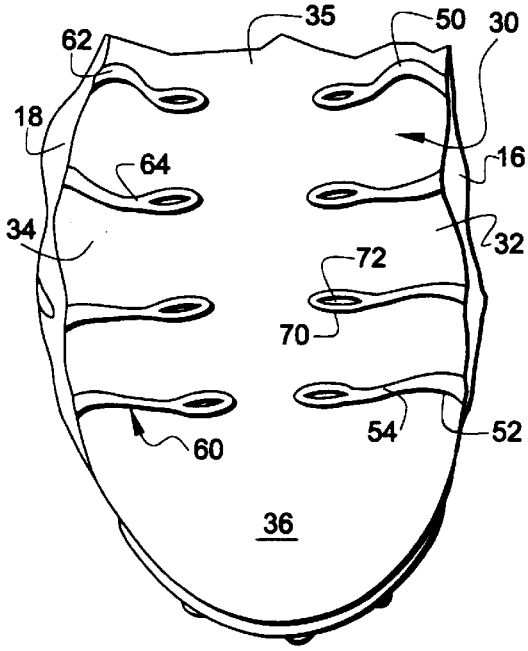

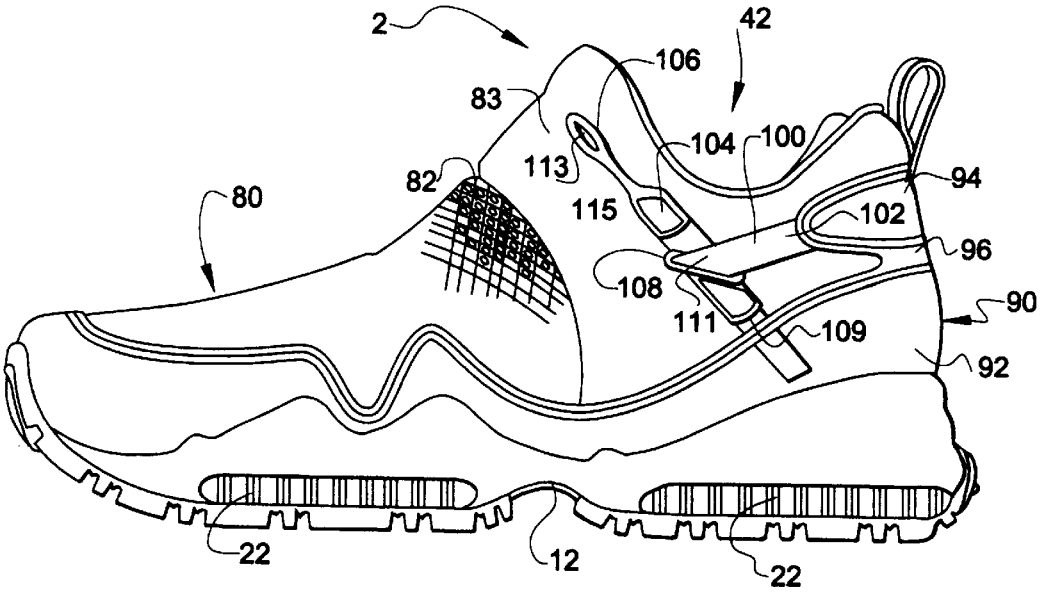
FIG. 5
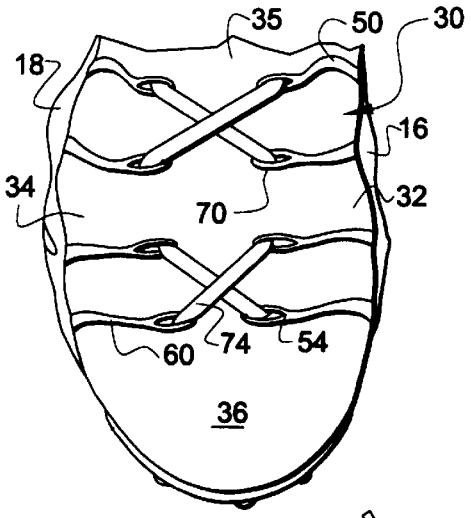
FIG. 6
FIG. 7
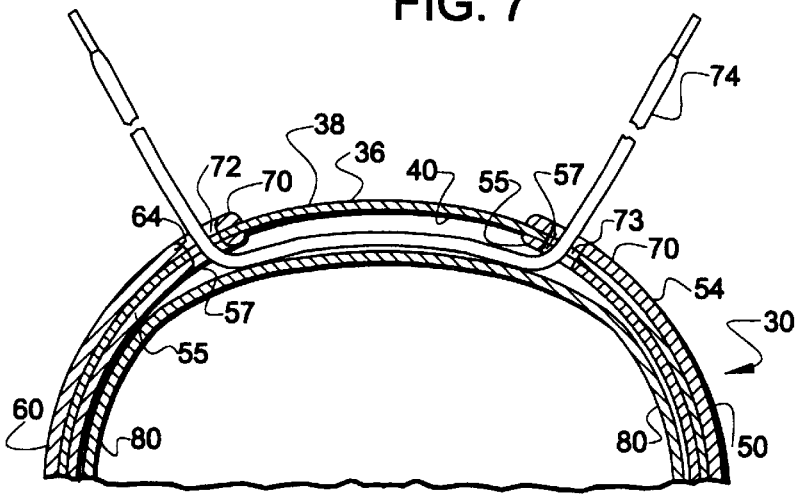

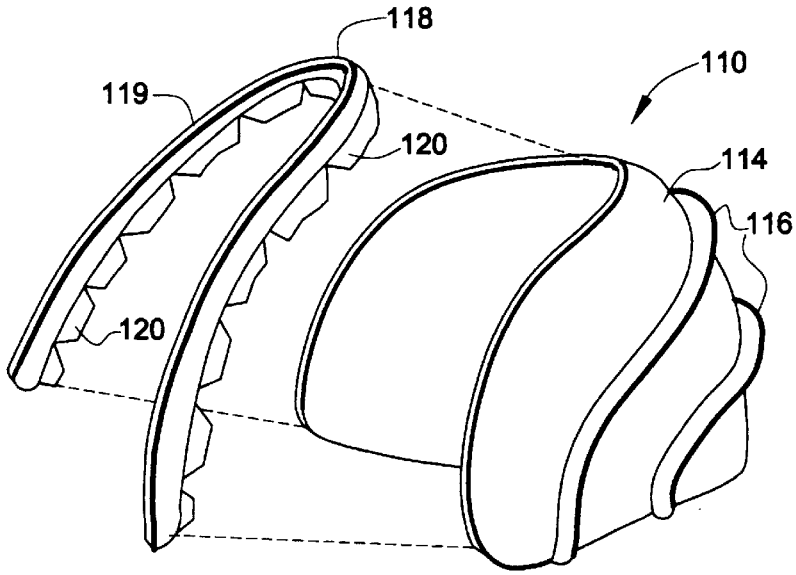
FIG. 8
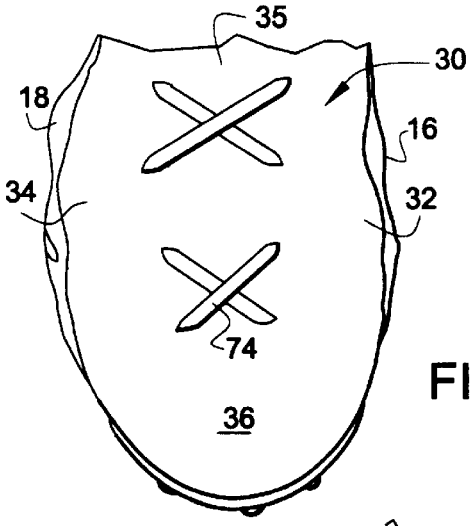
FIG. 9
FIG. 10
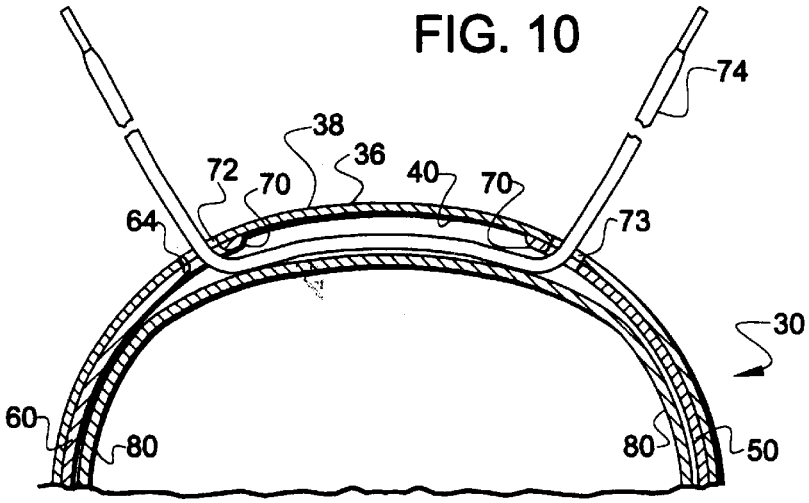

ARTICLE OF FOOTWEAR

FIELD OF THE INVENTION

This invention relates to an article of footwear, especially for athletic shoes. More particularly, the invention relates to a stable, comfortable, lightweight athletic shoe with an upper having an elastic sleeve and a fastening system including lace engaging support members attached to the sleeve and a lace extending through holes in the sleeve and the lace engaging support members.

BACKGROUND OF THE INVENTION

One function of a shoe is to protect and support the foot. To this end, a shoe, typically an athletic shoe, includes a sole to provide traction, support and cushioning. A shoe typically also includes an upper that is stitched and/or glued to the upper periphery of the sole. The upper is intended to hold the foot of the wearer to the sole, provide a tight and comfortable fit, and prevent sliding of the foot within the shoe. Sliding can occur when the upper does not properly conform to the foot leaving gaps between the foot and the upper, or when the upper has insufficient stiffness and deflects under loading. Sliding of the foot in the shoe may result in inefficient performance, instability, discomfort and injury.

Uppers are typically constructed of leather and other materials having properties similar to leather. Leather and other similar materials are inherently stiff and usually provide the necessary rigidity for supporting a foot in the shoe. However, the high stiffness of the leather can cause the wearer discomfort and adversely affect the shoe's ability to conform to the foot thereby affecting the performance of the wearer. Since an upper made from leather is heavy and thick, it requires a break-in period to gain flexibility. Additionally, leather materials may also be disadvantageous because they retain moisture and do not permit the foot to breathe.

The disadvantages of leather and leather-like materials for shoe upper construction led to the development of uppers constructed at least in part of various synthetic materials. Most of these synthetic materials are polymer meshes that are light and breathable. Meshes can be advantageous in athletic shoes where a lightweight shoe is important to the athlete's performance during athletic activities, e.g., running and walking events. The mesh also allows the foot to breathe thereby keeping the foot relatively dry during athletic activities. However, the same flexible qualities of the synthetic mesh materials renders them less than ideal in their role of tightly supporting the foot, especially under the large loading forces that are present during athletic activities.

More recently, hybrid-type uppers have been used that are constructed of a combination of the lightweight, more flexible, synthetic materials and stiffer materials such as leather straps and panels for reinforcement. Other shoes with hybrid-type uppers have used a stiff leather counter immediately above the sole and synthetic material stitched to the top of the counter. These shoes can be beneficial over shoes made completely of leather by increasing flexibility/breatheability and decreasing weight. However, these hybrid-type uppers still are comprised of a large percentage of overly stiff and heavy materials and are a suboptimal compromise of support, flexibility and breatheability.

The prior art also includes uppers which have one or more plastic or rubber elements melted to a sock structure. Uppers of this type are shown in U.S. Pat. Nos. 2,147,197 and 4,447,967. However, none of these uppers has developed the fulll advantages of the different components. Accordingly, an improved shoe upper for an article of footwear was needed.

SUMMARY OF THE INVENTION

It is an object of the present invention to provide a shoe that achieves support for a user's foot with a maximum amount of flexibility and breatheability with minimum weight.

In one aspect ofthe present invention, an article of footwear with a sole and an upper attached to the sole. The upper is made up of a tongueless outer sleeve with an outer surface, an inner surface and an opening through which a wearer's foot is inserted. The outer sleeve extends from the medial side of the sole to the lateral side of the sole. The outer sleeve is constructed of a woven elastic material that allows an easy insertion ofthe foot through the foot opening without the need for a split upper and tongue. The woven elastic material of the sleeve then "snaps back" into close conformity with the foot providing a comfortable fit. The woven elastic material is also light and breathable, making it ideal for athletic activities.

In another aspect of the present invention the article of footwear includes a flexible cage of lace engaging foot restraining members. The lace engaging foot restraining members include support elements and tensioning elements. The support elements are on the medial and lateral sides of the article of footwear. The support elements each have a lower end near the sole of the article of footwear and an upper end above the lower end. The support elements are bonded with the surface of the outer sleeve and are selectively placed to provide additional support for the upper without adding unnecessary weight and allowing maximum breatheability.

Another aspect of the invention includes a plurality of tensioning elements, which may also be directly attached to the outer sleeve. Each of the tensioning elements has a hole disposed above a hole in the outer sleeve. A lace is routed through the superimposed holes and the outer sleeve conceals a portion of the lace. The tensioning elements protect the outer sleeve from the stresses applied during lacing that can cause wear and tear, while the outer sleeve partially protects the laces.

A still further aspect of the invention includes an inner sleeve beneath at least the holes in the outer sleeve and the portion of the lace concealed by the outer sleeve. The inner sleeve provides a close and comfortable fit and isolates and protects the foot against pressure points caused by the lacing.

Another aspect of the invention includes a counter disposed above the sole, beneath the outer sleeve. The counter extends upwardly from the upper periphery of the sole. The counter includes a lower portion proximate to the sole and an upper portion wrapping around the heel of the upper. The two portions are separated by a neck. A heel strap has a firt end attached to the upper portion of the counter. The heel strap is threaded through a tensioning element of the outer sleeve and the other or second end of the strap is coupled to a lace for tightening the upper. When the lace is tensioned, it caused the heel strap to tension. This, in turn, causes deflection in the upper portion of the counter and draws the upper portion of the counter inwards around the heel of the foot. The counter serves to provide additional support to the foot in selected areas depending upon the demand of the sport for which the article of footwear is intended.

The invention provides an article of footwear having a sole and a tongueless upper attached to the sole. The upper has a medial side, a lateral side, an instep portion. The upper further includes woven sleeve disposed above the sole and extending from the medial side of the upper to the lateral side of the upper. The sleeve exhibits elastic behavior and has a foot opening so that a wearer may insert his or her foot through the opening. The sleeve also includes a plurality of lacing holes therein. A support cage, less elastic than the sleeve, is permeation bonded to the woven sleeve. The support cage includes foot restraining portions and lace engaging portions. The lace engaging portions are superimposed with a respective lacing hole in the sleeve. A lace is routed through the lace engaging portions and their respective lacing holes. The cage may be tightened or loosened around a foot of a wearer by manipulating the lace.

The invention also provides an article of footwear having a sole, an upper, a plurality of tensioning elements, and a lace. The sole includes a medial side and a lateral side. The upper is attached to the sole and has a foot opening for insertion of a foot of a wearer therethrough. The upper further includes an inner sleeve and an outer sleeve. The inner sleeve extends from the lateral side of the sole to the medial side of the sole. The outer sleeve is woven, disposed outside of the inner sleeve, and also extends from the lateral side of the sole to the medial side of the sole. The outer sleeve includes a plurality of lacing holes therein. The tensioning elements are attached to the outer sleeve and each of them has a hole therein. Each hole in each tensioning element is disposed above a respective lacing hole in the outer sleeve. The lace is routed in between the inner and outer sleeves and through the holes in the tensioning elements and the lacing holes in the outer sleeve enabling the adjustable tightening of the upper around a foot of a wearer.

According to another aspect of the invention, an article of footwear provides a sole, an upper attached to the sole, a counter, and a heel strap. The upper includes a medial side, a lateral side, and a tongueless sleeve. The sleeve is disposed above the sole and extends from the medial side of the upper to the lateral side of the upper. The sleeve has a foot opening disposed therethrough for insertion of a foot of a wearer. The sleeve also has a hole therethrough. The counter is disposed above the sole and inside the sleeve, and extends extending upwardly from the sole. The heel strap includes a first end connected to the counter, extends through the hole in the sleeve, and has a second end with a lace engaging portion.

The above and other objects, features and advantages of the present invention will be readily apparent and fully understood from the following detailed description of preferred embodiments, taken in connection with the appended drawings.

BRIEF DESCRIEPTION OF THE DRAWINGS

FIG. 1 is a side elevational view of the medial side of an article of footwear having an upper comprised of an outer elastic sleeve and bonded lace engaging foot restraining members of the current invention.

FIG. 2 is an enlarged view of the elastic sleeve of FIG. 1 showing the upper end of a lace engaging foot restraining member with an integrally-formed tensioning element.

FIG. 3 is a rear view of the article of footwear of FIG. 1 showing an external heel counter.

FIG. 4 is a top plan view of the article of footwear of FIG. 1 showing the lace engaging foot restraining members with their tensioning elements bonded to the outer elastic sleeve.

FIG. 5 is the medial side elevation view of the article of footwear of FIG. 1 with the outer elastic sleeve of the upper removed to reveal an inner sleeve, a counter and a heel strap.

FIG. 6 is a top plan view similar to FIG. 4 showing the tensioning elements at the end of the lace engaging foot restraining members threaded with a lace.

FIG. 7 is a vertical cross-sectional view taken transverse to the longitudinal axis of the shoe showing the relationship between the inner and outer sleeves and the lacing system.

FIG. 8 is an exploded assembly view of a portion of the external heel counter.

FIGS. 9 and 10 are views similar to FIGS. 6 and 7 showing an alternative embodiment where the lace engaging foot restraining members are attached to the inside surface of the outer sleeve.

DETAILED DESCRIPTION OF THE PREFERRED EMBODIMENTS

With reference to FIGS. 1–10, an article of footwear, for example an athletic shoe, in accordance with the present invention is illustrated. The article of footwear or shoe 2 includes a sole 10, with a medial side 16, a lateral side 18 and an upper periphery 20. Sole 10 may further include an outsole 12 and a midsole 14. Outsole 12 provides a lower ground engaging surface designed for traction and typically made of a tough rubber material for wear resistance. Midsole 14 provides cushioning and support and is more compressible than outsole 12 to achieve its cushioning function. Additionally, cushioning of the sole may also be aided by one or more air or gas containing bladders 22 in the midsole 14. Any conventional sole design may be used provided that it has sufficient support and traction for the foot of the wearer for the desired activity or sport to be performed.

The shoe 2 further includes an upper 30 secured to the sole 10 in any conventional manner, e.g., by stitching and/or gluing to the upper surface of sole 10. The upper includes a medial side 32 and a lateral side 34. Upper 30 includes an outer sleeve 36 as shown in FIGS. 1, 2, 4, and 7, and may also have an inner sleeve 80 such as shown in FIG. 5. Outer sleeve 36 has an outer surface 38 and an inner surface 40. A foot opening 42 enables a user to insert his or her foot through outer sleeve 36 and into the shoe 2. Outer sleeve 36 extends from the lateral side 18 of the sole to the medial side 16 of the sole and extends over the instep of the foot of the wearer. In a preferred arrangement, outer sleeve 36 covers the entire foot of the wearer. However, the outer sleeve 36 need only extend from the to thoe box region to the top of the eyestay region if an inner sleeve is used or if there material holding the heel of the wearer to the shoe. Outer sleeve 36 may be attached directly to sole 10, as in the present embodiment, comprising most of the external surface of upper 30, or outer sleeve 36 may only be a portion of upper 30.

Outer sleeve 36 behaves in an elastic manner to enable it stretch. This permit the outer sleeve 36 to expand to accept entry of a foot of a wearer. To accomplish this, outer sleeve 36 is preferably made from a woven material. The desired elastic behavior may be accomplished by using woven elastic fibers. In a preferred embodiment, outer sleeve 36 includes woven synthetic elastic fibers chiefly made from polyurethane, e.g., spandex. More specifically, a preferred embodiment is made from LYCRA™ or another spandex fiber. LYCRA™ is a trademark of the DuPont Corporation for its brand of elastane fiber. Outer sleeve 36 may also include other types of fibers to achieve desired characteristics. Accordingly, the woven material of outer sleeve 36 may be comprised of solely spandex or LYCRA™, or combinations of spandex and/or LYCRA™, and other materials such as nylon and/or cotton.

Additionally, these materials may also be constructed of a range of weave and knit patterns to vary the direction and amount of the elasticity of the outer sleeve 36. In a preferred embodiment, the material is woven to provide equal four-way stretch capabilities, meaning that it stretches equally along all four planar axes. However, if desired, the woven elastic material may be formed so that it stretches more in one direction than another, such as allowing the material to stretch more or less in the longitudinal direction than the vertical direction. That is, it can stretch more or less in the direction from the toe to the heel, than the direction from the ball of the foot to the top of the foot.

The material used for outer sleeve 36 is desirable because of its low weight and ability to contract into a close and conforming fit. Woven elastic materials are also remarkable for their ability to return to their original shape despite long use under large strains. Accordingly, the use of a woven elastic material allows upper 30 to elastically expand to great lengths under high loads and "snap back" to a tight but comfortable fit. The elasticity of outer sleeve 36 also allows the use of an integral continuous upper, i.e., a tongueless upper, because it expands easily for foot insertion and obviates the need for the split upper/tongue combination used in traditional shoes.

Upper 30 further includes medial and lateral lace engaging foot restraining members on the medial and lateral sides 32 and 34 of the upper 30. Each medial and lateral lace engaging foot restraining member has a respective support element 50 or 60 and a tensioning elements 70. The support elements 50, 60 primarily provide side support for the foot of the wearer and the tensioning elements 70 interface with a lace to adjust the tension applied by the support elements 50, 60.

Each medial support element 50 has a first or lower end 52 preferably located at or adjacent the medial side 16 of the sole 10 and a second or upper end 54 located at or adjacent the instep region 35 of the shoe 2, i.e., the region of the shoe that overlies the instep portion of the foot of the wearer. Similarly, each lateral support member 60 has a first or lower end 62 preferably located at or adjacent the lateral side 18 of the sole 10 and a second or upper end 64 located at or adjacent the instep region 35 of the shoe 2.

Support elements 50 and 60 are optimally made of a material that is less elastic than the outer sleeve 36. This makes the support elements 50 and 60 stiffer or less elastic than outer sleeve 36, and thereby stiffens upper 30 against foot loads and more securely holds the foot of the wearer to the sole 10. These loads can be rather extreme in many athletic activities. Support elements 50 and 60 are made from a flexible synthetic material such as a flexible plastic or rubber. More specifically, support elements 50 and 60 are made from a thermoplastic vinyl resin. Thermoplastic vinyl resin is a ductile polymer when hot and forms a smooth ridge of tough flexible polymer when cool.

Support elements 50 and 60 are preferably attached to the outer surface 38 of outer sleeve 36 by bonding the support elements 50, 60 to the outer sleeve 36 substantially along their entire length for optimal fixation. More specifically, the preferred affixing technique is "permeation bonding." Permeation bonding between a first member and second member, as referred to herein, is defined as causing a viscous or semi-viscous material to enter pores or gaps in one of the members and harden so that the first and second members bond together. A preferred technique for permeation bonding is by welding, whereupon a part of the material of the support element 50, 60 melts and flows into the gaps in the weave of the outer sleeve 36. Another technique for permeation bonding is by the use of an adhesive that enters into the gaps in the weave of the outer sleeve 36 and contacts the support element. Stitching is not a form of permeation bonding.

Specifically, with a preferred material for the support elements 50, 60, thermoplastic vinyl resin, preferred bonding techniques include high frequency ultrasonic welding and radio frequency welding. According to such welding techniques, a beam of energy is applied to melt at least a portion of the support elements 50, 60 into a viscous or semi-viscous material. This viscous or semi-viscous material flows into gaps inherent in the woven outer sleeve 36 and permeates the weave. The thermoplastic resin hardens and locks the support elements 50, 60 to the woven sleeve 36.

A variation to this welding technique is to place a chemically compatible thin piece of backing material 55 on the inner surface 38 of the outer sleeve 36 prior to applying the energy beam. When the energy beam is applied to the backing material 55 and/or the support elements 50, 60 viscous or semi-viscous material flows into the outside and/or the inside of woven outer sleeve 36 and permeates the weave. The viscous or semi-viscous material on one side of the outer sleeve 36 contacts the material from the other side of the outer sleeve 36, which may also be viscous or semi-viscous. These materials can contact on either side of the outer sleeve 36, or somewhere inside the weave of the outer sleeve 36. The meeting of these materials causes the backing material 55 to chemically bond with the support element 50, 60 upon hardening. When the material hardens, it will harden around the woven outer sleeve 36. The strength ofthe bond achieved by either welding technique allows the use of a flexible material for support elements 50, 60 that will not bite into the foot when tightened.

In another permeation bond variation, the flexible plastic material forming the support elements 50 and 60 can be directly injected onto the outer sleeve 36 in its liquid state. The liquid permeates into or through the outer sleeve 36 and hardens to form the support elements 50, 60. In the welding and direct injection methods, flexible plastic material permeates the woven fabric of the outer sleeve 36 to cause a bond therebetween, and provide seamless support for the foot.

Alternatively, adhesives may be used to attach the support elements 50 and 60 to the outer sleeve 36. If adhesives are used, the adhesive permeates the woven fabric of the outer sleeve 36 to cause a bond between the outer sleeve 36 and the tensioning elements 50, 60, and provide seamless support for the foot.

Although bonding of support elements 50, 60 substantially along their entire length is preferred, they may also be bonded on only a portion of their length or surface. Further, if flexible plastic material is used for the support elements 50, 60, any conventional plastic to fabric bonding technique may be used. The above-described techniques of permeation bonding form a substantially continuous and flush attachment between the support element 50, 60 and the outer sleeve 36 that allows the support elements 50, 60 to retain their inherent flexibility with minimal relative motion between them and the outer sleeve 36.

Support elements 50 and 60 may optionally be further secured on their lower end 52 and 62 to sole 10 by bonding or other known techniques. However, it is noted that support elements 50, 60 may terminate near the sole 10 without being fixed to the sole 10 or they may terminate above the sole 10.

Support elements 50 and 60 originate at or near the sole 10 curving upwardly towards the instep region 35 and terminating at their upper end 54 and 64. Support elements 50 and 60 may be linear or curved to follow the draft line of the foot at strategic points to increase flexibility and allow a better fit. The lateral support members 60 are preferably equal in number and construction to medial support elements 50 and may also be matched in a regularly spaced pattern and shape. In the current embodiment lateral and medial support elements 50, 60 have a long and thin shape, with a length greater than 5, 10, or even 15 times their width. For example, a support element 50, 60 may be 3/16 inch wide for most of its length and 2½ inches long. Additionally, the support elements 50, 60 may protrude approximately 1/16, 3/32, or 1/8 inch from the outer surface of outer sleeve 36, and have a curved outer surface in cross-section. The number of support elements 50 and 60, as well as their patterns, shape, curvature and spacing may be varied depending upon the desired characteristics of support and flexibility. For example, if the shoe 2 is designed for a sport that generates a great deal of lateral forefoot motion, the support elements 50 and 60 may be concentrated towards the front of the shoe 2.

As shown in the figures, the support elements 50, 60 may be separate and distinct from one another. This permits independent control of the tensioning of the support elements 50, 60. However, if desired, two or more than two adjacent support elements 50, 60 can be coupled together by one or more strips or joining segments, not shown, extending between the support elements 50, 60. The strips orjoinging segments can be integral to the support elements 50, 60 themselves. Such an arrangement provides additional lateral support of the foot and lowers the elasticity of the upper in the longitudinal direction.

Tensioning elements 70 are attached to the upper ends 54 and 64 of support elements 50 and 60. Tensioning elements 70 are ideally formed of a material less elastic than outer sleeve 36, and have a hole 72, hook, or other accommodation to interface with a flexible element, e.g., a shoe lace 74, for fastening the foot of the wearer in the shoe 2. Thus, when the lace 74 is routed through the hole 72 of the tensioning elements 70, and the lace 74 is tightened, it will draw tensioning elements 70 together and tighten the fit of upper 30 and support elements 50, 60 around the wearer's foot by pulling the support elements 50 and 60 upward and inward around and against the foot of the wearer. In a preferred embodiment, the tensioning elements 70 are made from the same material as, and are integrally formed with, the support elements 50 and 60. The tensioning elements 70 can therefore be bonded to the outer surface of outer sleeve 36 the same manner as the remainder of the support aelements 50, 60. However, it is recognized that tensioning elements 70 need not be made of the same material as the support elements 50, 60, be formed integrally with the support elements 50, 60, or be attached directly to outer sleeve 36. For example, tensioning elements 70 may be separate loops or hooks that are attached only to support elements 50, 60.

As shown in FIGS. 2 and 7, the hole 72 in each tensioning element 70 is superimposed over a respective hole 73 in outer sleeve 36. Hole 73 allows a lace 74 to be passed through outer sleeve 36 thereby allowing outer sleeve 36 to conceal the lace 74 below the outside surface of the outer sleeve 36 until it is run back up and through superimposed holes 72 and 73 in a second tensioning element 70. Partial concealment of lace 74 under outer sleeve 36 serves to further minimize lace wear. If backing material 55 is used, as shown in FIG. 7, a hole 57 is placed therein in a superimposed relationship to holes 72 and 73 in the tensioning element 70 and the outer sleeve 36 so that the lace 74 may be easily routed therethrough. If desired, the superimposed holes 72 and 73 or holes 72, 73, and 57, may be formed in a single operation so as to be formed simultaneously and ensure alignment.

Preferably, an equal number of support elements 50, 60 with tensioning elements 70 are on the medial and lateral sides 32 and 34 of upper 30 allowing any suitable lacing pattern, such as shown in FIG. 6. The tensioning elements 70 connected to support elements 50, 60 form a "flexible cage" or an "exoskeletal support system" that envelopes the foot and provides excellent support without being overly stiff or heavy. When coupled with the lightweight breathable woven elastic material of outer sleeve 36, the flexible cage optimizes breatheability, comfort and minimizes shoe weight, ideal for an athletic shoe.

While not required, an inner sleeve 80 may be used. Inner sleeve 80 preferably provides adjustible support in a sock-like fit around the foot of the wearer. Inner sleeve 80 can also cushion the top of the foot of the wearer from any possible pressure points caused by tension in support elements 50, 60 and/or lace 74. Inner sleeve 80 accomplishes this by distributing the contact forces caused by the lace 74 and the support elements 50, 60 under the outer sleeve 36 as the lace 74 is drawn for tightening. Inner sleeve 80 may envelop substantially the entire foot of the wearer as in FIG. 5 by being connected directly to upper periphery 20 of sole 10. Alternatively, inner sleeve 80 may be of a smaller size preferably extending below any desired portion of the lace 74 and/or the underside of any tensioning elements 70 or support elements 50, 60. If desired, inner sleeve 80 can be provided with a separation or break in it. In a preferred embodiment, inner sleeve 80 is constructed of a first or front portion of breathable mesh 82 material that is soft, lightweight and comfortable for allowing the foot to breathe. Inner sleeve 80 may also include a second or rear portion 83 constructed from a neoprene foam that provides a comfortable, foot-conforming fit, and protects from any bunching of outer sleeve 36, without a significant increase in weight. Inner sleeve 80 may also be made of a woven elastic material, similar or the same as outer sleeve 36, such as spandex to allow it to open wide when receiving a foot and snap back around the foot. If desired, inner sleeve 80 and outer sleeve 36 may be seamed together. If such an assembly technique is used, the entire sock structure can be attached to sole 10 after the flexible cage is bonded to outer sleeve 36. Further, if an inner sleeve 80 is used, it may be preferable to route the lace 74 through the holes 72 and 73 in the outer sleeve 36 and the tensioning elements 70 prior to attachment of the sleeves 36 and 80 to the sole 10.

A counter 90 may be used as a part of the inner sleeve 80 if extra support is desired. Counter 90 is a stiffened portion of upper 30 disposed beneath outer sleeve 36, and is preferably made from leather, a synthetic leather, or a similar material. Counter 90 may be attached as an extra layer to front and rear portions 82, 83 of inner sleeve 80 if the front and rear portions 82, 83 extend down to the sole 10. In the alternative, the front and rear portions 82, 83 may be attached to the upper edge of the counter 90. Counter 90 extends upwardly from upper periphery 20 of sole 10 and includes a first or lower portion 92, a second or heel portion 94 and a neck 96. Lower portion 92 is proximate to upper periphery 20 of sole 10 and further secures the base of a foot by resisiting medial and lateral motion of the foot of the wearer. Heel portion 94 wraps up and around the heel of upper 30 and is separated from first portion 92 by neck 96. Heel portion 94 of counter 90 supports the heel and Achilles tendon area of the foot of a wearer. Counter 90 provides further support to shoe 2 especially in the heel and toe region not enclosed by the flexible cage. Counter 90 may be varied in many ways to optimize support and minimize weight depending upon the type of activity. For instance, it may be beneficial for some soccer shoes to include the additional stiffness provided by a counter along the kicking surfaces of the shoe, whereas some running shoes may desire more flexibility and may not include a counter or only include a counter in the toe and heel region.

The counter 90 may be used as part of a heel locking system that locks the upper 30 tightly about the narrow Achilles heel portion of the foot of the wearer by pulling on selected sections of the heel portion 94 of counter 90. The heel locking system includes a heel strap 100, a lace receiving element 106, and a strap redirecting element 108 on both sides of the shoe 2. Each heel strap 100 includes a rear end 102 and a front end 104. The rear end 102 of the strap 100 is attached to the heel portion 94 of the counter 90. The front end 104 includes a lace receiving element 106 for receiving lace 74. The heel strap 100 runs from its rear end, through a slot 111 in strap redirecting element 108, and the receving element 106 at its front end 104 extends through the outer sleeve 36. The strap redirecting element 108 has a connecting strap 109 extending from its lower end that is attached to the counter 90. In one embodiment, the strap redirecting element 108 is a molded plastic narrow ring, but may be any of a number of elements that smoothly redirect heel strap 100 such as a D-shaped ring, circular ring, a buckle, etc. Strap redirecting element 108 is attached to first portion 92 of counter 90 and serves to redirect heel strap 100 upwardly. However, the emerging position of heel strap 100 may be varied by a differently shaped and positioned strap redirecting element 108.

As shown in FIG. 1, lace receiving element 106 emerges through outer sleeve 36 from an appropriately-sized hole 72 in an appropriately-sized tensioning element 70 at the top of shoe 2. As shown, the lace receiving element 106 includes a neck 115 for extending through hole 72 in a tensioning element 70 and a hole 113 therein to receive lace 74 for tensioning of heel strap 100. Lace receiving element 106 is preferably made from molded plastic and may take any desired form including an eyelet, grommet, D-shaped ring, circular ring, a hook, etc. as long as it secures lace 74 or a lace equivalent to heel strap 100 for tensioning. Thus, the tightening of the lace 74 pulls the lace receiving element 106 upwardly. This, in turn, pulls the connecting strap 109 and counter 90 upwardly for side support, and the heel portion 94 forwardly and slightly inwardly and downwardly around the heel of the wearer. This also pulls up on the sole near the heel and brings the ankle collar inwardly for a snug, stable fit. Variations in the design of the strap redirecting element 108 or the elimination of strap redirecting element 108 can be made to change the direction of pull on heel portion 94. This can result in a variation of the tightness of fit that may be tailored to the type of activity or sport for which shoe 2 is made.

The heel region of upper 30 may be further reinforced by an optional external heel counter 110 that wraps around and may be bonded, stitched, glued, etc. to the heel portion of outer sleeve 36. Heel counter 110 provides even further support for the wearer's heel during athletic activities. In a preferred embodiment, the external heel counter 110 is made from a skin 114 of material similar to the outer sleeve 36, and a numbers of strengthening ribs 116 which are made from the same material as the support elements 50 and 60. The strengthening ribs 116 are applied to the skln 114 in the same manner that the support elements 50, 60 are applied to the outer sleeve 36. The top and side portions of the perimeter of skin 114 is sewn onto a nylon strip 118. The nylon strip 118 includes an ornamental strip 119 and a number of downwardly depending teeth 120. In a preferred embodiment, the external heel counter 110 is attached to the heel section of the outer sleeve 36 by ultrasonic or high-frequency welding the teeth 120 to the outer sleeve 36.

Although this specification details several aspects of this invention it is not meant to be limiting. For insance, the outer sleeve 36 may be chemically treated to have intrinsic water and wear resistant properties for outdoor use. Additionally, the outer sleeve 36 may wrap over midsole 12 and be embedded between the midsole 14 and outsole 12.

Further, support elements 50, 60 can be configured in many different positions to allow support to be selectively applied to upper 30 while maintaining low weight and a close fit. Support elements 50, 60 may also vary in height, thickness and shape to support different portions of the foot and/or differently distribute the lacing forces. For example medial support elements 50 may run entirely over the instep of the foot onto lateral side 34 of upper 30. Additionally, as shown in FIGS. 9 and 10, the support elements 50, 60 may be attached to the inside surface of outer sleeve 36 instead of its outside surface. This effectively conceals the support elements 50, 60.

The present invention has been described in terms of preferred and exemplary embodiments thereof. Accordingly, numerous other embodiments, modifications and variations within the scope and spirit of the appended claims will occur to persons of ordinary skill in the art from a review of this disclosure.

What is claimed is:

1. An article of footwear, comprising:

a sole;

a tongueless upper attached to said sole, said upper having a medial side, a lateral side, and an instep portion, the upper including a sleeve, said sleeve includes woven elastic fibers and is disposed above said sole and extending from the medial side of said upper to the lateral side of said upper, said sleeve exhibiting elastic behavior and having a foot opening for insertion of a foot of a wearer therethrough, said sleeve including a plurality of lacing holes therein; and a support cage permeation bonded to the woven sleeve, the support cage including foot restraining portions less elastic than said sleeve, and lace engaging portions, each lace engaging portion superimposed with a respective lacing hole in said sleeve; and a lace routed through said lace engaging portions and their respective lacing holes, whereby manipulation of the lace causes tightening or loosening of the cage around a foot of a wearer.

2. An article of footwear, comprising:

a sole;

a tongueless upper attached to said sole, said upper having a medial side, a lateral side, and an instep portion, the upper including a sleeve, said sleeve includes woven elastic fibers and is disposed above said sole and extending from the medial side of said upper to the lateral side of said upper, said sleeve exhibiting elastic behavior and having a foot opening for insertion of a foot of a wearer therethrough, said sleeve including a plurality of lacing holes therein; and a support cage permeation bonded to the woven sleeve, the support cage including foot restraining portions less elastic than said sleeve, and lace engaging portions, each lace engaging portion superimposed with a respective lacing hole in said sleeve; and a lace routed through said lace engaging portions and their respective lacing holes, whereby manipulation of the lace causes tightening or loosening of the cage around a foot of a wearer;

wherein said sleeve is an outer sleeve, said article of footwear further comprising an inner sleeve extending beneath said outer sleeve and extending from the sole on medial side of the article of footwear to the sole on the lateral side of the article of footwear.

3. The article of footwear of claim 3, wherein said inner sleeve includes a breathable mesh material.

4. The article of footwear of claim 3, wherein said lace extends between the inner and outer sleeves.

5. The article of footwear of claim 3, wherein said inner sleeve and said outer sleeve form a dual-layer sock construction that substantially envelopes the entire forefoot of the wearer.

6. The article of footwear of claim 1, wherein said support cage is made from a thermoplastic vinyl resin.

7. The article of footwear of claim 1, wherein support cage includes a plurality of medial and lateral supports, each support having an upper end, a lower end, a length defined as the distance from its upper end to its lower end and a width defined as the distance between opposing sides of the support taken in a direction transverse to the length, wherein at least two of the supports include a length to width ratio of at least 5 to 1.

8. The article of footwear of claim 7, wherein the sleeve includes an outer surface, said medial and lateral supports have a thickness of at least 3/32 inch measured from the outer surface of the sleeve away from the article of footwear.

9. The article of footwear of claim 8, wherein said medial and lateral supports are curved between their upper and lower ends.

10. The article of footwear of claim 1, wherein said support cage includes a plurality of medial and lateral supports, said medial and lateral supports attached to said sole.

11. The article of footwear of claim 1, wherein said support cage includes a plurality of medial and lateral supports, said medial and lateral supports are attached to an outside surface of said sleeve.

12. The article of footwear of claim 1, wherein said support cage includes a plurality of medial and lateral supports, said medial and lateral supports are separate and distinct from one another.

13. The article of footwear of claim 1, further comprising an external heel counter permeation bonded to said sleeve.

14. An article of footwear comprising:

a sole;

a tongueless upper attached to said sole, said upper having a medial side, a lateral side, and an instep portion, the upper including a sleeve, said sleeve includes woven elastic fibers and is disposed above said sole and extending from the medial side of said upper to the lateral side of said upper said sleeve exhibiting elastic behavior and having a foot opening for insertion of a foot of a wearer therethrough, said sleeve including a plurality of lacing holes therein; and a support cage permeation bonded to the woven sleeve, the support cage including foot restraining portions less elastic than said sleeve and lace engaging portions, each lace engaging portion superimposed with a respective lacing hole in said sleeve; and a lace routed through said lace engaging portions and their respective lacing holes, whereby manipulation of the lace causes tightening or loosening of the cage around a foot of a wearer;

wherein said support cage includes a plurality of medial and lateral supports, said medial and lateral supports are attached to an inside surface of said sleeve.

15. An article of footwear, comprising:

a sole;

a tongueless upper attached to said sole, said upper having a medial side, a lateral side, and an instep portion, the upper including a sleeve, said sleeve includes a woven elastic fibers and is disposed above said sole and extending from the medial side of said upper to the lateral side of said upper, said sleeve exhibiting elastic behavior and having a foot opening for insertion of a foot of a wearer therethrough, said sleeve including a plurality of lacing holes therein; and a support cage permeation bonded to the woven sleeve, the support cage including foot restraining portions less elastic than said sleeve, and lace engaging portions, each lace engaging portion superimposed with a respective lacing hole in said sleeve; and a lace routed through said lace engaging portions and their respective lacing holes, whereby manipulation of the lace causes tightening or loosening of the cage around a foot of a wearer; and a heel strap located inside said sleeve.

16. An article of footwear, comprising:

a sole, said sole including a medial side and a lateral side;

an upper attached to said sole and having a foot opening for insertion of a foot of a wearer therethrough, said upper further including an inner sleeve extending from the lateral side of the sole to the medial side of the sole and a woven outer sleeve disposed outside of said inner sleeve and extending from the lateral side of the sole to the medial side of the sole, said outer sleeve including a plurality of lacing holes therein;

a plurality of tensioning elements attached to said outer sleeve, each of said tensioning elements having a hole therein, each hole in each said tensioning element disposed above a respective lacing hole in said outer sleeve; and a lace, said lace routed in between said inner and outer sleeves and through said holes in said tensioning elements and said lacing holes in said outer sleeve enabling the adjustable tightening of the upper around a foot of a wearer.

17. The article of footwear of claim 16, wherein said outer sleeve is made from woven elastane fibers.

18. The article of footwear of claim 16, wherein said tensioning elements are permeation bonded to the woven outer sleeve.

19. The article of footwear of claim 18, wherein said tensioning elements are made from a plastic material.

20. The article of footwear of claim 19, wherein said tensioning elements are made from a molded thermoplastic vinyl resin.

21. The article of footwear of claim 16, wherein said tensioning elements are attached to an inside surface of said outer sleeve.

22. The article of footwear of claim 16, wherein said tensioning elements are attached to an outside surface of said outer sleeve.

23. The article of footwear of claim 16, wherein said upper includes a medial side and a lateral side, said tensioning elements include medial tensioning elements on the medial side of the upper and lateral tensioning elements on the lateral side of the upper, said article of footwear further comprising:

a plurality of medial supports, each medial support having an upper end and a lower end, said medial supports permeation bonded to said outer sleeve on the medial side of said upper, said lower end of each medial support disposed near the medial side of said sole, each said medial support having its upper end disposed above its lower end, each of said medial supports being attached to a respective one of said medial tensioning elements; and a plurality of lateral supports, each lateral support having an upper end and a lower end, said lateral supports permeation bonded to said outer sleeve on the lateral side of said upper, said lower end of each lateral support disposed near the lateral side of said sole, each said lateral support having its upper end disposed above its lower end, each of said lateral supports being attached to a respective one of said lateral tensioning elements.

24. The article of footwear of claim 23, wherein each said medial tensioning element is integrally formed with its respective medial support, and each said lateral tensioning element is integrally formed with its respective lateral support.

25. The article of footwear of claim 23, wherein said medial and lateral supports are composed of a material less elastic than said sleeve.

26. The article of footwear of claim 16, further comprising a heel strap located inside said outer sleeve.

27. The article of footwear of claim 16, further comprising an external heel counter permeation bonded to said outer sleeve.

28. The article of footwear of claim 16, wherein said upper is tongueless.

29. An article of footwear, comprising:

a sole;

an upper attached to said sole, said upper including a medial side, a lateral side, and a tongueless sleeve, said sleeve disposed above said sole and extending from the medial side of said upper to the lateral side of said upper, said sleeve having a foot opening disposed therethrough for insertion of a foot of a wearer, said sleeve including a hole therethrough;

a counter disposed above said sole, and inside said sleeve; said counter extending upwardly from said sole;

a heel strap including a first end and a second end, said first end connected to said counter, said second end having a lace engaging portion, and said strap extending through said hole in the sleeve.

30. The article of footwear of claim 29, wherein said sleeve is made from woven elastane fibers.

31. The article of footwear of claim 29, further including, a plurality of tensioning elements attached to said outer sleeve, and a lace routed through said tensioning elements and said lace engaging portion of said strap.

32. The article of footwear of claim 31 wherein said tensioning elements are made from a molded thermoplastic vinyl resin.

33. The article of footwear of claim 29, wherein said counter includes a lower portion proximate to said sole, and an upper portion extending around the heel of said article of footwear, said lower portion delineated from said upper portion by a neck, said first end of said strap connected to said upper portion of said counter.

34. The article of footwear of claim 33, fuirther comprising a strap redirecting device coupled to said lower portion of said counter, said strap redirecting device having a hole therein, said strap routed through said hole in said strap redirecting device.

35. The article of footwear of claim 29, further comprising an external heel counter permeation bonded to an outer surface of said sleeve.

* * * * *

UNITED STATES PATENT AND TRADEMARK OFFICE

CERTIFICATE OF CORRECTION

PATENT NO. : 6,029,376
DATED : February 29, 2000
INVENTOR(S) : William J. CASS

It is certified that error appears in the above-identified patent and that said Letters Patent is hereby corrected as shown below:

On the cover page, item [54] and Col.1 in the title, after "FOOTWEAR", -- WITH AN ELASTIC SLEEVE AND FASTENING SYSTEM -- has been inserted;

in the inventor section, after "William", --J.-- has been inserted.

In Claim 3, column 11, line 12, "claim 3" has been deleted, and --claim 2-- has been inserted.

In Claim 4, column 11, line 14, "claim 3" has been deleted, and --claim 2-- has been inserted.

In Claim 5, column 11, line 16, "claim 3" has been deleted, and --claim 2-- has been inserted.

In Claim 9, column 11, line 34, "claim 8" has been deleted, and --claim 7-- has been inserted.

In Claim 14, column 11, line 51, after "footwear", --,-- has been inserted;

line 59, after "upper", --,-- has been inserted.

In Claim 34, column 14, line 31, "fuirther" has been deleted, and --further-- has been inserted.

Signed and Sealed this

Sixth Day of February, 2001

*Attest:*

Q. TODD DICKINSON

*Attesting Officer*

*Director of Patents and Trademarks*